US012760538B2

(12) United States Patent
Martinez

(10) Patent No.: US 12,760,538 B2
(45) Date of Patent: Oct. 13, 2026

(54) BAFFLE DEVICE FOR DECK FORMS

(71) Applicant: Jesus Martinez, Platteville, CO (US)

(72) Inventor: Jesus Martinez, Platteville, CO (US)

( * ) Notice: Subject to any disclaimer, the term of this patent is extended or adjusted under 35 U.S.C. 154(b) by 189 days.

(21) Appl. No.: 18/626,434

(22) Filed: Apr. 4, 2024

(65) Prior Publication Data

US 2025/0314082 A1 Oct. 9, 2025

(51) Int. Cl.
*E04G 11/36* (2006.01)

(52) U.S. Cl.
CPC ..... *E04G 11/365* (2013.01)

(58) Field of Classification Search
CPC ..... E04G 11/36; E04G 11/365; E04G 11/38; E04G 11/40; E04G 11/42; E04G 11/46; E04B 5/40
See application file for complete search history.

(56) References Cited

U.S. PATENT DOCUMENTS

| | | | | |
|---|---|---|---|---|
| D245,535 | S | 8/1977 | Segil | |
| 4,151,694 | A | 5/1979 | Sriberg et al. | |
| 5,906,076 | A * | 5/1999 | Mc Manus | E04G 11/48 52/354 |
| D556,560 | S | 12/2007 | Tsuda | |
| D612,534 | S | 3/2010 | Mayfield, III | |
| 8,707,645 | B1 | 4/2014 | Boeshart | |
| 9,181,713 | B1 | 11/2015 | Farahmandpour | |
| D773,922 | S | 12/2016 | Fiebig | |
| D872,883 | S | 1/2020 | Bilge | |
| 10,895,080 | B1 | 1/2021 | MacKenzie | |
| D926,556 | S | 8/2021 | Claudin | |

(Continued)

FOREIGN PATENT DOCUMENTS

| | | | | |
|---|---|---|---|---|
| KR | 200376885 Y1 * | 3/2005 | ..... | E04B 5/40 |
| KR | 102061430 B1 * | 12/2019 | ..... | E04B 5/40 |
| KR | 20200045061 A * | 5/2020 | ..... | E04G 11/40 |

OTHER PUBLICATIONS

"Adjustable Wall or Beeam Sleeve—AMI Decking Adapter Plate" available at kcscott.net/ami-decking-adapter-plate.html, dated Nov. 3, 2008.

(Continued)

*Primary Examiner* — Brian D Mattei
*Assistant Examiner* — Audrey Fisher
(74) *Attorney, Agent, or Firm* — Trenner Law Firm, LLC; Mark Trenner

(57) ABSTRACT

A baffle device for a deck form for pouring concrete. An example baffle device includes a spine for extending across adjacent channels formed in the deck form. The example baffle device also includes channel partitions provided on the spine for fitting within the channels formed in the deck form. The channel partitions substantially block concrete poured in the deck form from flowing past the channel partitions. The example baffle device also includes a perimeter edge of each of the channel partitions shaped to substantially mirror a profile of each of the channels formed in the deck form. The example baffle device also includes a raised partition assembled over the spine to form a wall that substantially blocks concrete poured above the channels in the deck form from flowing past the raised partition. The example baffle device also includes an opening through the channel partitions to receive a rebar.

20 Claims, 9 Drawing Sheets

(56) References Cited

U.S. PATENT DOCUMENTS

| | | | | |
|---|---|---|---|---|
| D1,030,466 | S | 6/2024 | Schuknecht | |
| 12,031,563 | B1 | 7/2024 | Roth | |
| D1,042,094 | S | 9/2024 | Luis | |
| 2015/0139719 | A1* | 5/2015 | Zhang | E04C 3/293 403/266 |
| 2018/0187429 | A1 | 7/2018 | Lim | |
| 2019/0309521 | A1* | 10/2019 | Lutz | E04B 7/18 |

OTHER PUBLICATIONS

"Foam Closures For Metal Decking" available at https://www.metaldeck.com/foam-closures-metal-decking, printed from the Internet and available at least as early as Jan. 24, 2024.

"Structural Considerations for Openings in Composite Floor Decks" in Structure Magazine, available at https://www.structuremag.org/?p=16271, dated Aug. 2020.

"Composite and Non-Composite Design Guide V1.0" of ASC Steel Deck and available at www.ascsd.com, copyright 2018.

* cited by examiner

BAFFLE DEVICE FOR DECK FORMS

BACKGROUND

During construction of multi-level buildings, such as office buildings, warehouses, and even residential buildings such as apartments and condominiums, it is often necessary to pour concrete for each floor. While the concrete can be poured directly on the ground floor without any additional structure, raised floors typically require the installation of deck forms in which the concrete can be poured.

The concrete that is poured into a deck form may need to be contained to specific areas and/or excluded from other areas. Traditionally, a closed-cell extruded polystyrene foam (or XPS, such as STYROFOAM™ brand foam) or other foam material and/or lumber (e.g., 2×4 lumber, plywood, chipboard, etc.) is installed as a baseplate to hold down 1×4 or plywood cut to fit over the wire mesh. The foam has to be cut by hand, so that each angel on the deck form can be filled by the foam cutout. These foam pieces then have to be hand-fitted into place so that the concrete is blocked from flowing past the bulkhead. After the concrete hardens, all of this material (lumber and foam) has to be removed by hand and/or cut out using saws and other power tools. This is both a labor-intensive and material-intensive process, increasing the cost of construction. It can also be a potentially dangerous use of saws and other power tools.

DETAILED DESCRIPTION

A baffle device is disclosed as it may be implemented with a deck form for pouring concrete. An example of the baffle device includes a spine for extending across adjacent channels formed in the deck form. The example baffle device also includes adjacent channel partitions provided on the spine for fitting within the adjacent channels formed in the deck form. In an example, the adjacent channel partitions are spaced substantially equally apart from one another along a length of the spine. The channel partitions substantially block concrete poured in the deck form from flowing past the channel partitions. The example baffle device also includes a perimeter edge of each of the channel partitions shaped to substantially mirror a profile of each of the adjacent channels formed in the deck form.

In an example, the baffle device also includes a raised partition assembled over the spine to form a wall that substantially blocks concrete poured above the adjacent channels in the deck form from flowing past the raised partition. The raised partition can be assembled over the spine after a wire mesh is laid on the spine to sandwich the wire mesh between the spine and the raised partition.

In an example, the baffle device also includes the adjacent channel partitions each have an opening formed therethrough to receive a rebar.

In an example, the baffle device also includes a notch on each of the adjacent channel partitions. The notch accommodates a ridge formed in the bottom portion of the adjacent channels formed in the deck form.

The example baffle device can be made from any suitable material. In an example, the baffle device is made of a thin gauge metal that is cut and bent to conform to the deck form. The baffle device holds the reinforcing rebar and wire mesh in place while concrete is poured into the deck form. The baffle device takes up less room and is much cleaner than traditional foam material and lumber blocking. The baffle device can be configured to fit any deck form and to accommodate any block outs in the deck. The baffle device can also be left in place or removed after the concrete has been poured. This helps eliminate the need to chop out the foam material and lumber after the concrete has hardened.

The example baffle device reduces manpower needed to install and remove traditional foam and wood blocking. The example baffle device requires less skill level to install, and can be installed without the need for potentially dangerous saws and other power tools. The example baffle device is cleaner, safer, faster, more cost effective to install and remove, and indeed, the example baffle device can even be left in place after pouring the concrete.

Before continuing, it is noted that as used herein, the terms "includes" and "including" mean, but is not limited to, "includes" or "including" and "includes at least" or "including at least." The term "based on" means "based on" and "based at least in part on."

Figure 1:
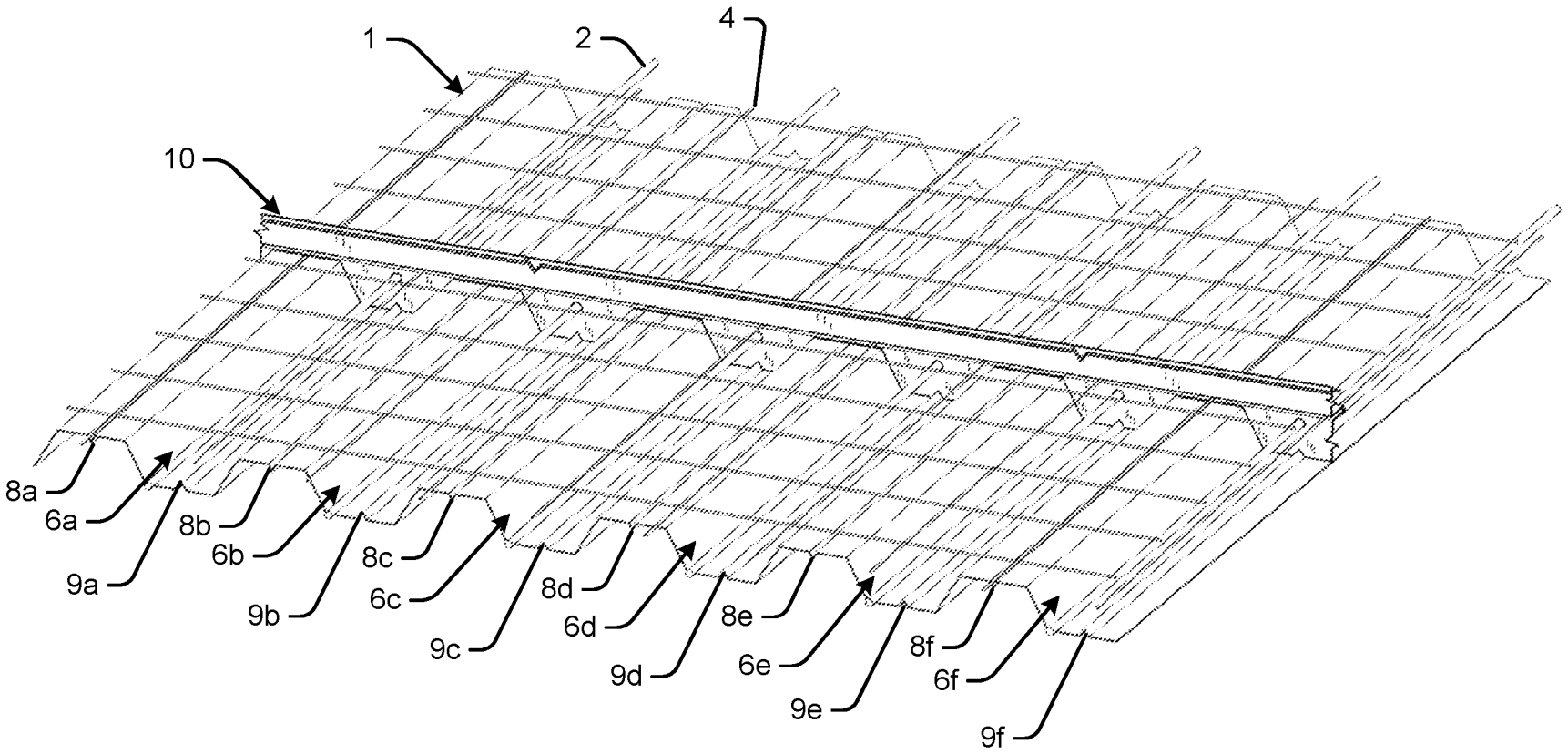
FIG. 1 is an isometric view showing an example baffle device prepared with rebar and a wire mesh for installation in a deck form.

FIG. 1 is an isometric view showing an example baffle device 10 prepared with rebar 2 and a wire mesh 4 for installation in a deck form 1. The baffle device 10 may be fabricated from any suitable material, such as, but not limited to, sheet metal, and a steel piece with an L-shaped cross section such as a so-called "angle iron." The baffle device 10 is configured to conform to the deck form 1 and keep concrete from flowing out of and/or into a predetermined area or space. The configuration of the baffle device 10 suspends the reinforcement rebar 2 in the appropriate position in the poured concrete, and allows the reinforcement wire mesh 4 to be tied into the next concrete placement.

The baffle device 10 may be implemented for a deck form 1 for pouring concrete and containing the concrete within a predetermined area or space. In an example, the baffle device 10 includes a spine 12 for extending across adjacent channels 6*a*-6*f* formed in the deck form 1. It is noted that the deck form 1 may have any number of channels 6*a*-6*f*.

Adjacent channel partitions 14*a*-14*c* are provided on the spine for fitting within the adjacent channels 6*a*-6*f* formed in the deck form 1. A perimeter edge of each of the channel partitions 14*a*-14*c* is shaped to substantially mirror a profile of each of the adjacent channels 6*a*-6*f* formed in the deck form 1 so as to substantially conform or mate with and mostly, if not fully, block the channels 6*a*-6*f*.

The spine 12 may be configured with any suitable number of channel partition(s) 14*a*-*d*, and the number of channel partition(s) 14*a*-*d* need not match the number of adjacent channels 6*a*-6*f* in the deck form 1. Indeed, the baffle device 10 may come with a predetermined number of channel partitions 14*a*-14*c*, and be cut to size to reduce (and/or additional baffle devices 10 may provide more channel partitions 14*a*-14*c*) on the project site based on the number of channel partitions 14*a*-14*c* needed for a particular project and/or portion of the project. After installation in the deck form 1, the channel partitions 14*a*-14*c* substantially block concrete poured in the deck form 1 from flowing past the channel partitions 14*a*-14*c*.

In an example, the baffle device 10 also has a raised partition 16 that can be assembled over the spine 12. The raised partition 16 forms a wall that substantially blocks concrete poured above the adjacent channels 6*a*-6*f* in the deck form 1 from flowing past the raised partition 16.

The raised partition 16 can be assembled over the spine 12 after a wire mesh 4 is laid on the spine 12 to sandwich the wire mesh 4 between the spine 12 and the raised partition 16. The raised partition 16 may be tack welded or otherwise connected (e.g., tied, clipped, or clamped) to the spine 12. In another example, the raised partition 16 may be connected to the spine 12 without use of the wire mesh 4. For example, the raised partition 16 may be formed as part of the spine 12.

In an example, the adjacent channel partitions 14*a*-14*c* are spaced substantially equally apart from one another along a length of the spine 12. The adjacent channel partitions 14*a*-14*c* each have an opening 22*a*-22*c* formed therethrough to receive a rebar 2. A notch 18*a*-18*c* can be formed in or otherwise provided on each of the adjacent channel partitions 14*a*-14*c*, respectively. The notch 18*a*-18*c* accommodates a ridge 8*a*-*f* formed in the bottom portion of the adjacent channels 6*a*-6*f* formed in the deck form 1.

Before continuing, it should be noted that the examples described above are provided for purposes of illustration, and are not intended to be limiting. Other devices and/or device configurations may be utilized to carry out the operations described herein.

The operations shown and described herein are provided to illustrate example implementations. It is noted that the operations are not limited to the ordering shown. Still other operations may also be implemented.

Figure 2:
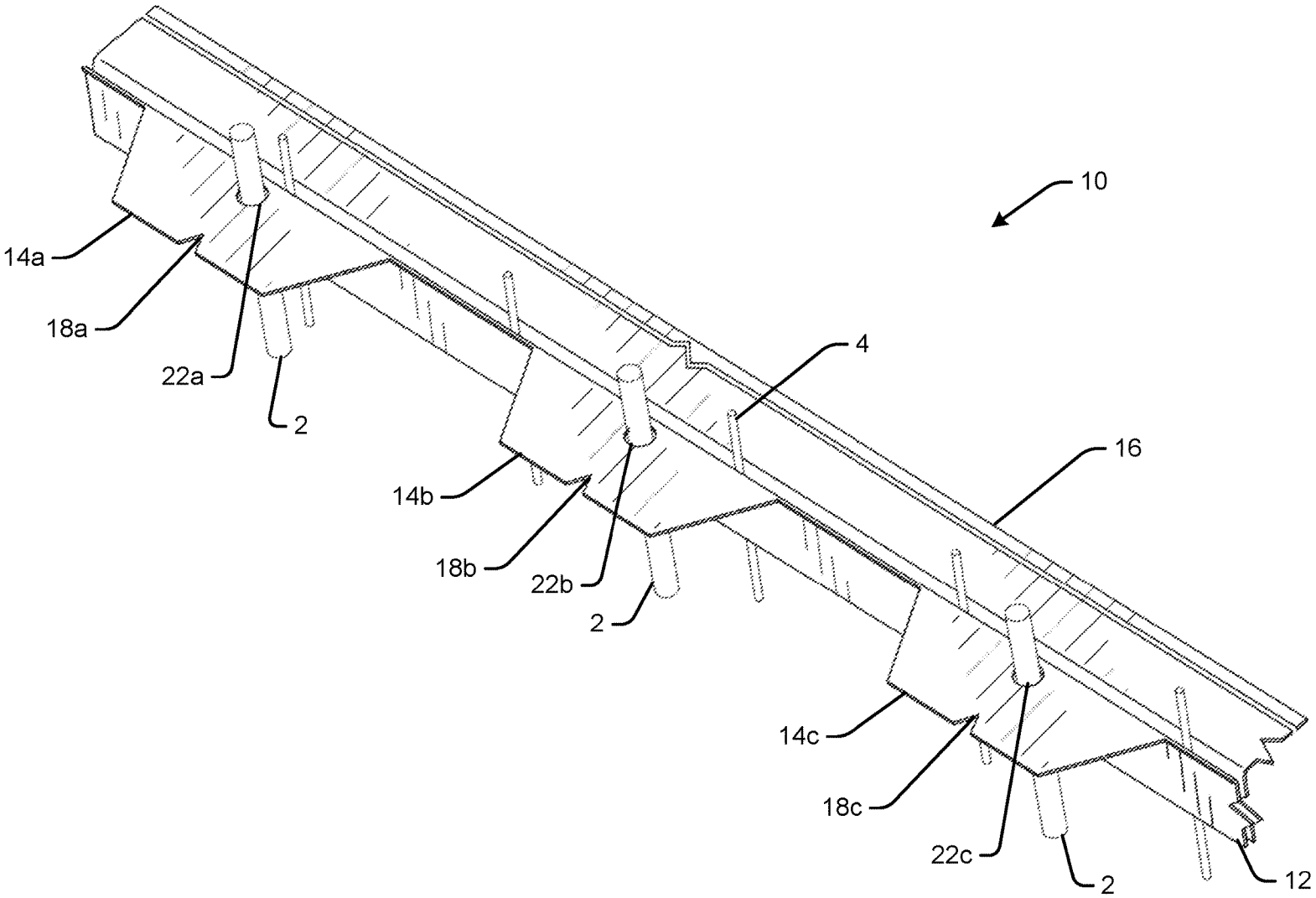
FIG. 2 is a front isometric view of the baffle device.
Figure 3:
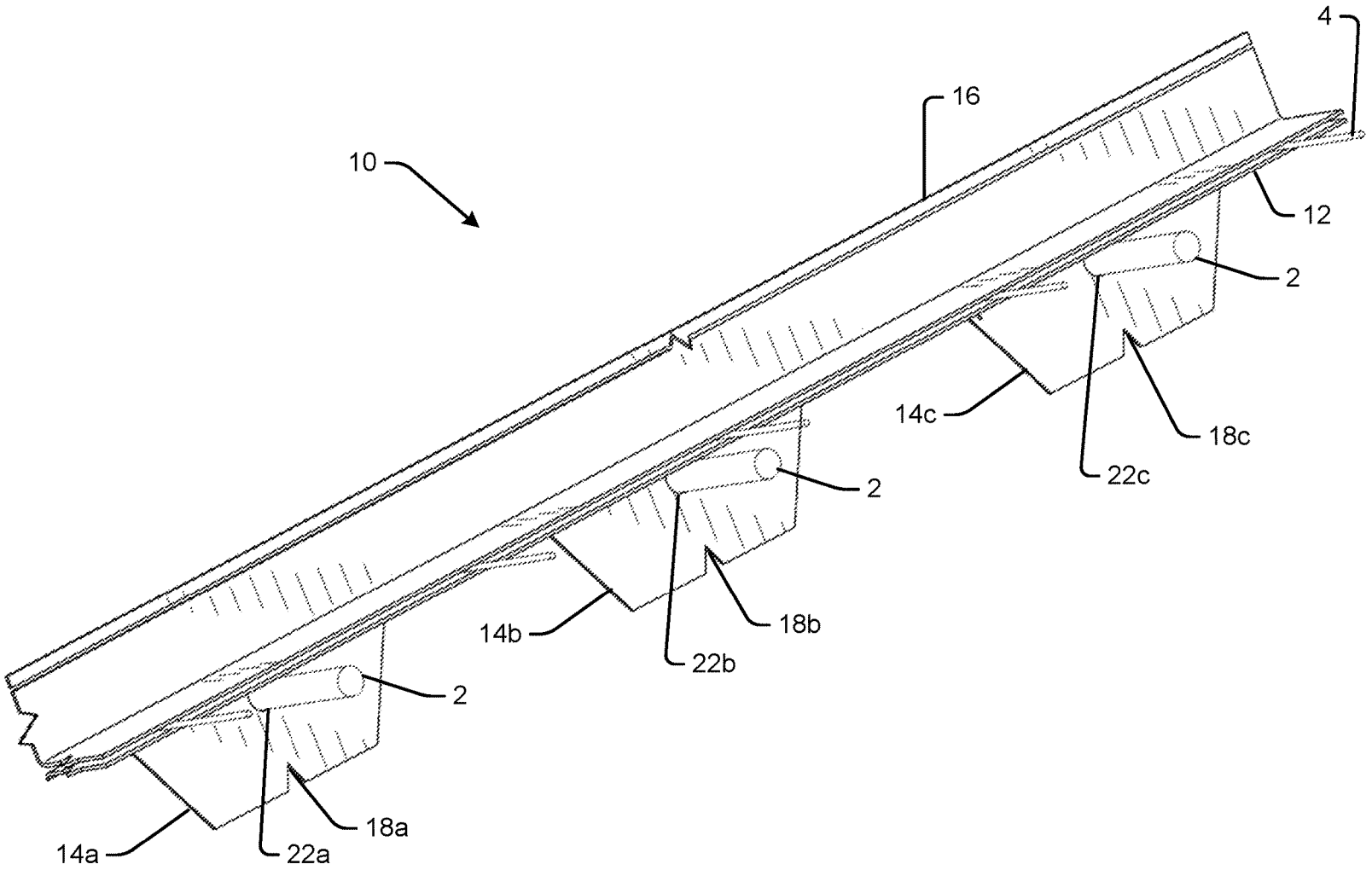
FIG. 3 is a back isometric view of the baffle device.
Figure 4:
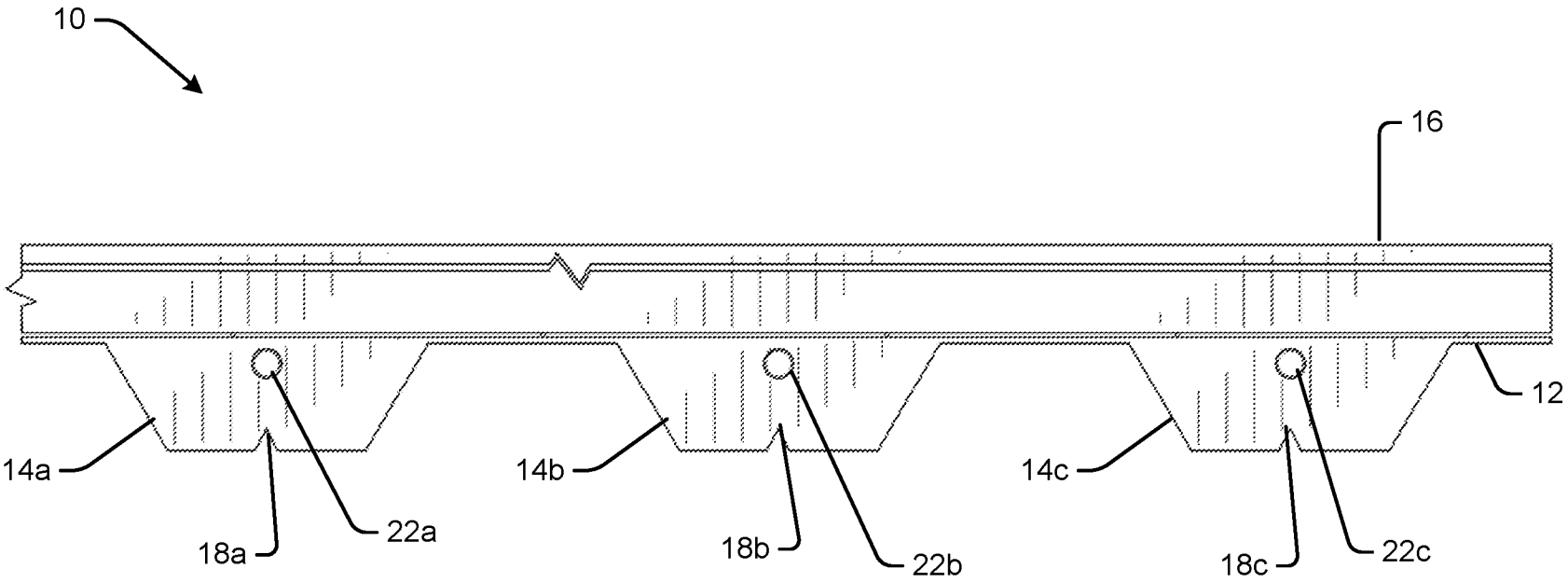
FIG. 4 is a front view of the baffle device corresponding to FIG. 2.
Figure 5:
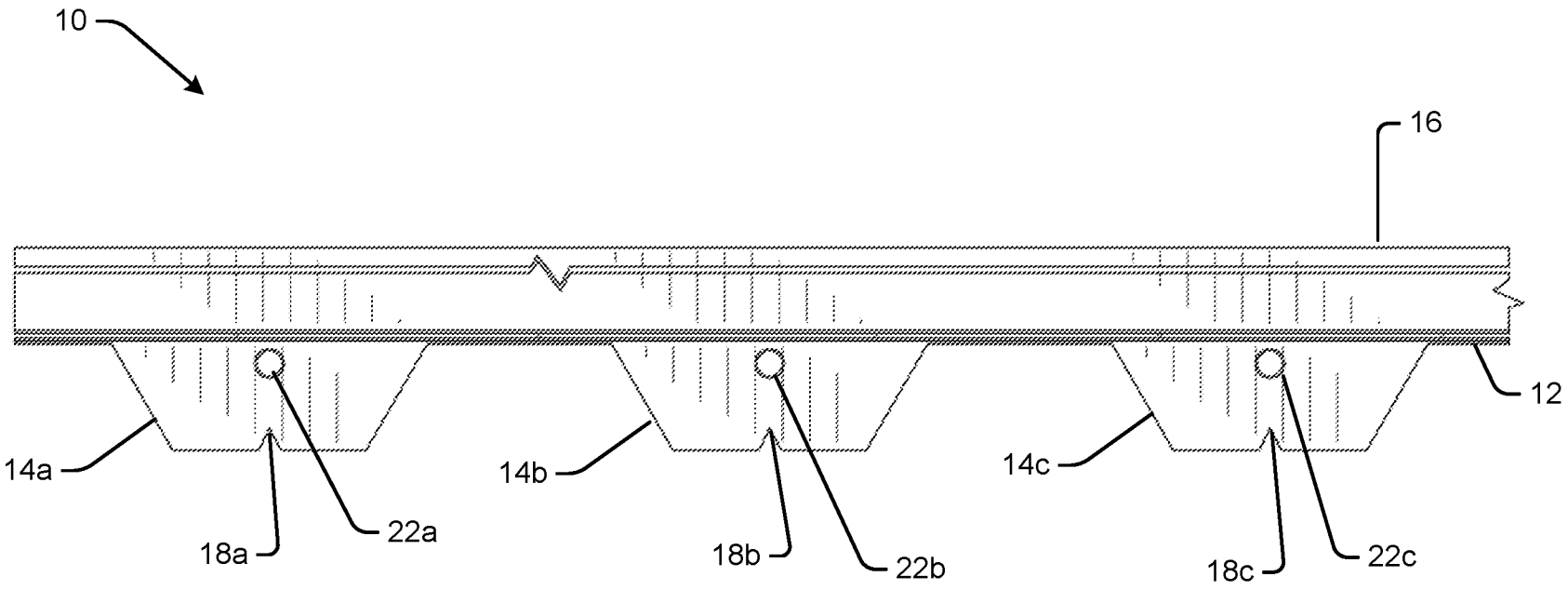
FIG. 5 is a back view of the baffle device corresponding to FIG. 3.
Figure 6:
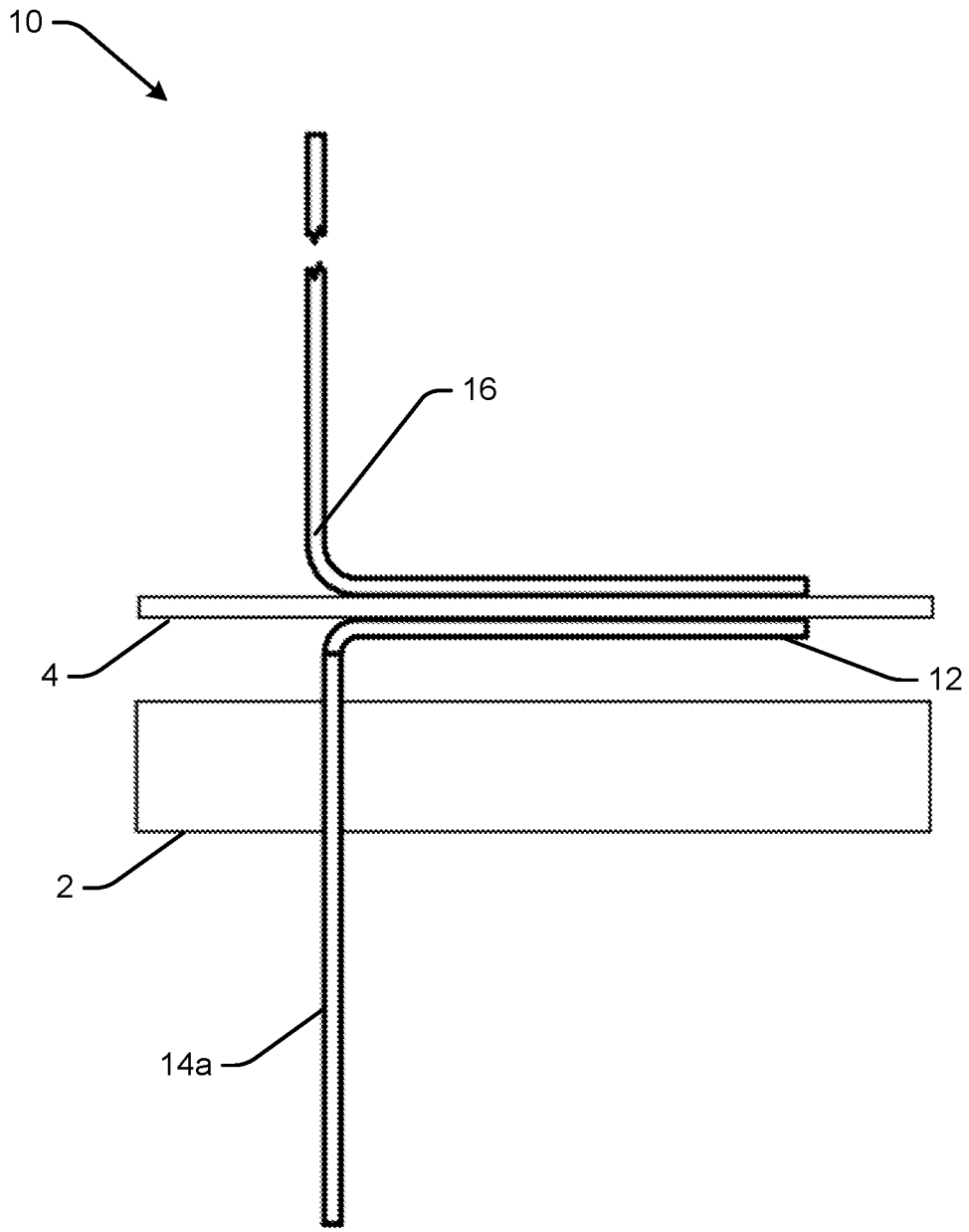
FIG. 6 is a side view of the baffle device.
Figure 7:
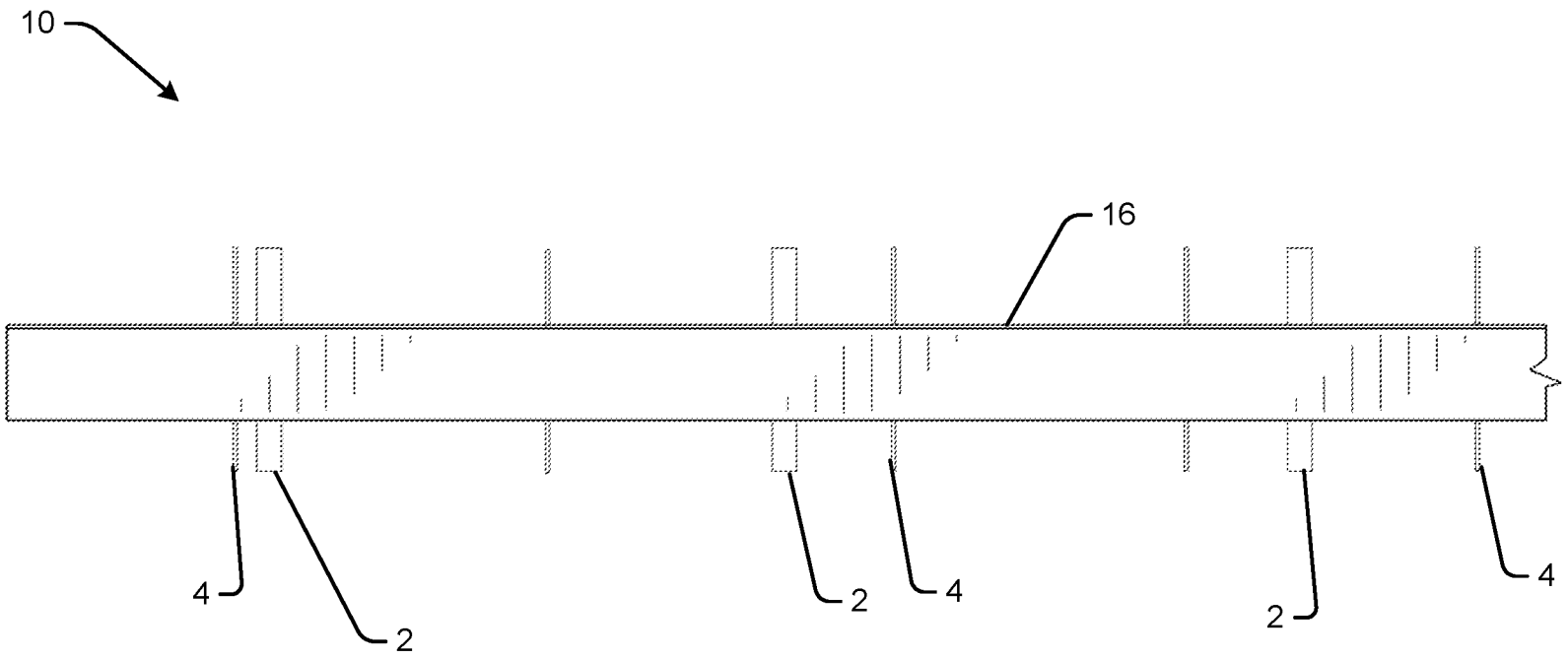
FIG. 7 is a top view of the baffle device.
Figure 8:
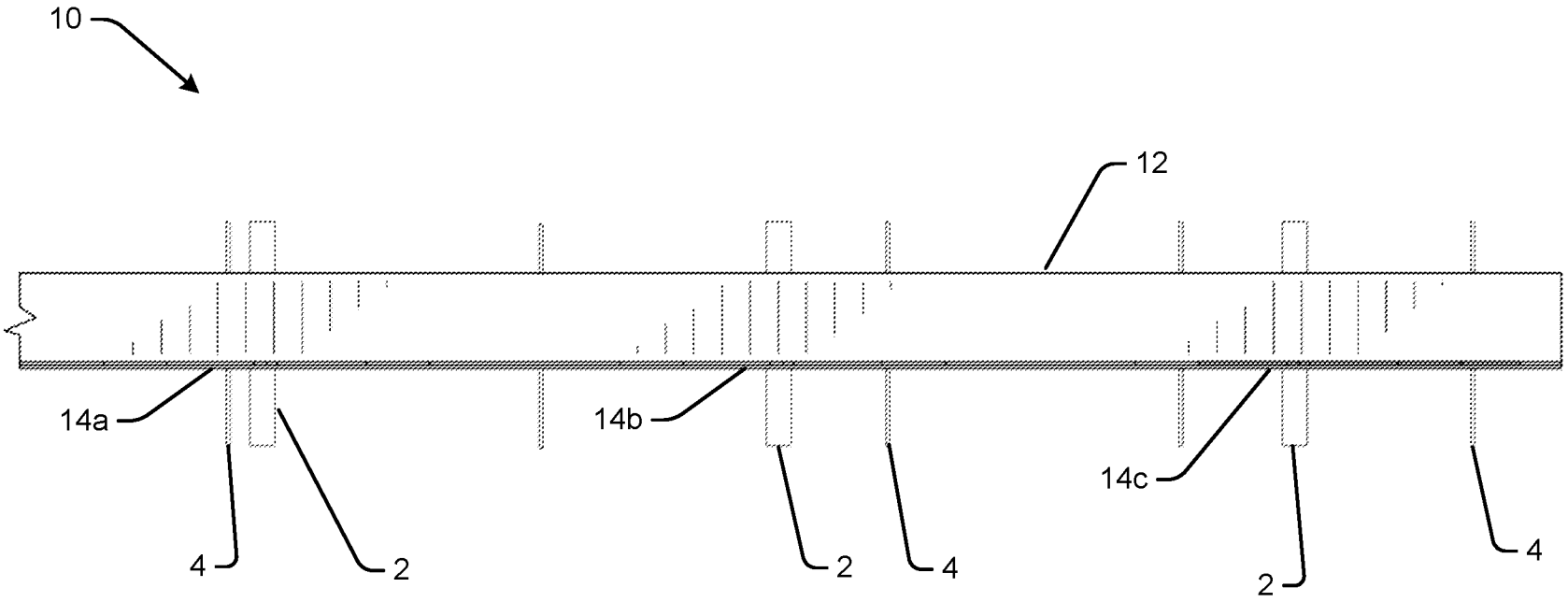
FIG. 8 is a bottom view of the baffle device.
Figure 9:
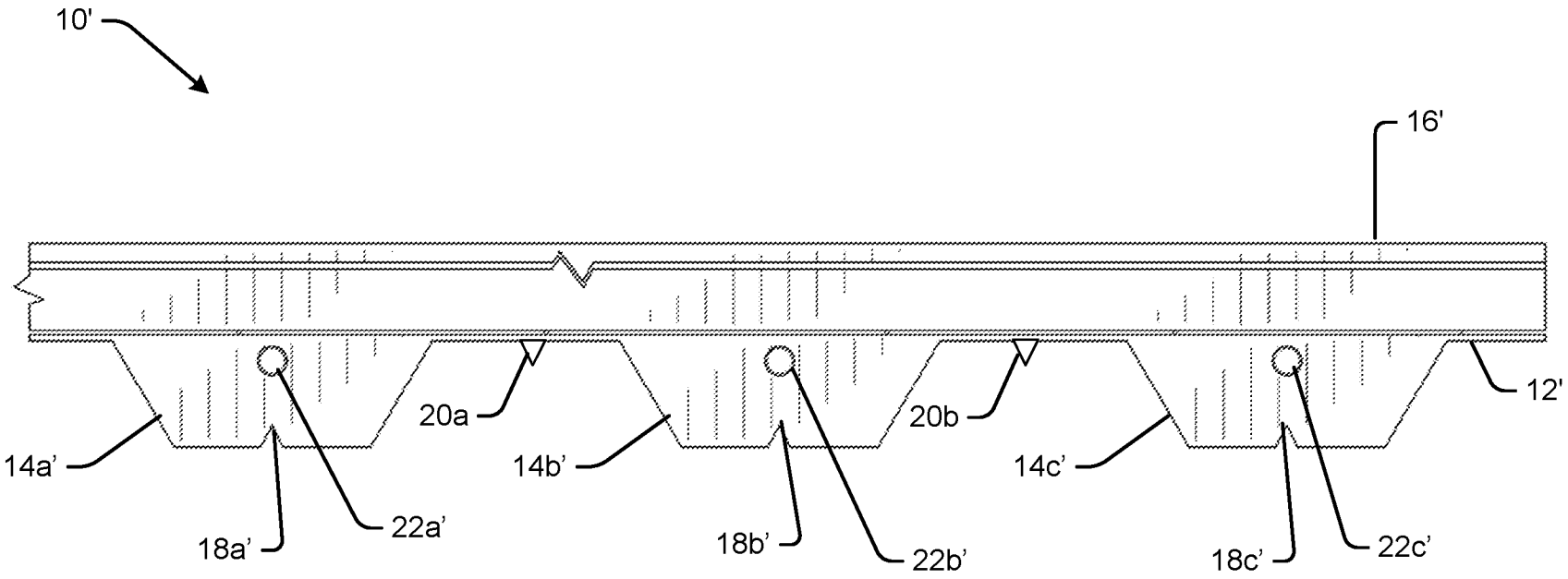
FIG. 9 is a front view of another example of the baffle device having an inverted notch.

FIGS. 2-8 are various views of the example baffle device 10. FIG. 2 is a front isometric view of the baffle device 10. FIG. 3 is a back isometric view of the baffle device 10. FIG. 4 is a front view of the baffle device 10 corresponding to FIG. 2. FIG. 5 is a back view of the baffle device 10 corresponding to FIG. 3. FIG. 6 is a side view of the baffle device 10. FIG. 7 is a top view of the baffle device 10. FIG. 8 is a bottom view of the baffle device 10. FIG. 9 is a front view of another example of the baffle device 10' having an inverted notch 20*a*-20*b*. It is noted that prime (') reference numbers are used to refer to like components already described with respect to the other figures, and that those components are not described again separately for FIG. 9.

The baffle device 10 shown in FIGS. 2-8 may be implemented for a deck form 1 when pouring concrete as described above with reference to FIG. 1. In an example, the baffle device 10 includes a spine 12 for extending across a plurality of adjacent channels 6*a*-6*f* formed in the deck form 1. The example baffle device 10 also includes one or more channel partition 14*a*-14*c* on the spine 12 for fitting within one of the plurality of adjacent channels 6*a*-6*f* formed in the deck form 1. The channel partition 14*a*-14*c* substantially blocks concrete poured in the channels 6*a*-6*f* of the deck form 1 from flowing past the channel partition 14*a*-14*c*.

In an example, there are a plurality of channel partitions 14*a*-14*c* formed along the spine 12. Any number of channel partitions 14*a*-14*c* may be provided on a single spine 12. The plurality of channel partitions 14*a*-14*c* can be equally spaced apart from one another along a length of the spine 12. For example, the plurality of channel partitions 14*a*-14*c* may be spaced apart from one another at a distance substantially equal to a lower width of each channel partition 14*a*-14*c*. In an example, an inverted notch 20*a*-20*b* can be provided on the spine 12 between each of the plurality of channel partitions 14*a*-14*c* to fit over an inverted rib 9*a*-9*d* formed between each of the channels 6*a*-6*f* of the deck form 1.

In an example, the baffle device 10 also includes a raised partition 16 extending at least partly along a length of the spine 12. For example, the raised partition 16 can have a first side and a second side forming a substantially L-shape. The first side of the raised partition 16 is provided adjacent and/or attached or otherwise connected to the spine 12 (e.g., via tack welding, ties, clips, etc.), and the second side of the raised partition forms the wall. The raised partition 16 forms a wall to substantially block concrete poured above the plurality of adjacent channels 6*a*-6*f* in the deck form 1 from flowing past the raised partition 16. The raised partition 16 is set over the spine 12 after a wire mesh 4 is laid on the spine 12 to sandwich the wire mesh 4 between the spine 12 and the raised partition 16.

In an example, the channel partition 14*a*-14*c* has an opening 22*a*-22*c* formed therethrough to receive rebar 2 through the channel partition 14*a*-14*c*. The channel partition 14*a*-14*c* is shown as it may be substantially W-shaped.

The channel partition 14*a*-14*c* may have a plurality of perimeter edges. A first perimeter edge is formed along the first side of the channel partition 14*a*-14*c*. The first perimeter edge is shaped to substantially correspond to a shape of a first side portion of the one of the plurality of adjacent channels 6*a*-6*f* formed in the deck form 1.

In an example, the channel partition 14*a*-14*c* may also have a second perimeter edge formed along a second side of the channel partition 14*a*-14*c*. The second perimeter edge is shaped to substantially correspond to a shape of a second side portion of the one of the plurality of adjacent channels 6*a*-6*f* formed in the deck form 1.

In an example, the channel partition 14*a*-14*c* has a third perimeter edge formed along a bottom side of the channel partition 14*a*-14*c*. The third perimeter edge is shaped to substantially correspond to a shape of a bottom portion of the one of the plurality of adjacent channels 6*a*-6*f* formed in the deck form 1.

In an example, the first and second perimeter edges of the channel partition 14*a*-14*c* have opposing angles to one another corresponding to opposing angles of the first and second side portions in the one of the plurality of adjacent channels 6*a*-6*f* formed in the deck form 1 hat the channel partition 14*a*-14*c* fits into.

In an example, the third perimeter edge may have a notch 18*a*-18*c* to accommodate a ridge 8*a*-8*f* formed in the bottom portion of the one of the plurality of adjacent channels 6*a*-6*f* formed in the deck form 1 that the channel partition 14*a*-14*c* fits into.

It is noted that the examples shown and described are provided for purposes of illustration and are not intended to be limiting. Still other examples are also contemplated.

The invention claimed is:

1. A baffle device for a deck form for pouring concrete, comprising:

a spine comprising an elongated member having an L-shaped cross section and configured to extend across a plurality of adjacent channels formed in the deck form;

a plurality of channel partitions on the spine, each channel partition extending downward from the spine and configured to fit within a respective one of the plurality of adjacent channels formed in the deck form, the channel partition substantially blocking concrete poured in the deck form from flowing past the channel partition;

a first perimeter edge formed along a first side of the channel partition, the first perimeter edge shaped to substantially correspond to a shape of a first side portion of the one of the plurality of adjacent channels formed in the deck form;

a second perimeter edge formed along a second side of the channel partition, the second perimeter edge shaped to substantially correspond to a shape of a second side portion of the one of the plurality of adjacent channels formed in the deck form;

a third perimeter edge formed along a bottom side of the channel partition, the third perimeter edge shaped to substantially correspond to a shape of a bottom portion of the one of the plurality of adjacent channels formed in the deck form and a raised partition comprising a second elongated member having an L-shaped cross-section and assembled over the spine to form a vertical wall above the spine, the raised portion cooperating with the spine to substantially block concrete poured above the adjacent channels.

2. The baffle device of claim 1, further comprising a raised partition extending at least partly along a length of the spine, the raised partition forming a wall to substantially block concrete poured above the plurality of adjacent channels in the deck form from flowing past the raised partition.

3. The baffle device of claim 2, wherein the raised partition is set over the spine after a wire mesh is laid on the spine to sandwich the wire mesh between the spine and the raised partition.

4. The baffle device of claim 2, further comprising wherein the raised partition has a first side and a second side forming a substantially L-shape.

5. The baffle device of claim 3, wherein the first side of the raised partition is attached to the spine, and the second side of the raised partition forms the wall.

6. The baffle device of claim 1, wherein the first perimeter edge and the second perimeter edge have opposing angles to one another corresponding to opposing angles of the first and second side portions in the one of the plurality of adjacent channels formed in the deck form that the channel partition fits into.

7. The baffle device of claim 1, wherein the third perimeter edge has a notch to accommodate a ridge formed in the bottom portion of the one of the plurality of adjacent channels formed in the deck form that the channel partition fits into.

8. The baffle device of claim 1, wherein the channel partition has an opening formed therethrough to receive a rebar through the channel partition.

9. The baffle device of claim 1, wherein the channel partition is substantially W-shaped.

10. The baffle device of claim 1, further comprising a plurality of channel partitions formed along the spine.

11. The baffle device of claim 10, wherein the plurality of channel partitions are equally spaced apart from one another along a length of the spine.

12. The baffle device of claim 10, wherein the plurality of channel partitions are spaced apart from one another at a distance substantially equal to a lower width of each channel partition.

13. The baffle device of claim 10, further comprising an inverted notch on the spine between each of the plurality of channel partitions to fit over an inverted rib formed between each of the channels of the deck form.

14. A baffle device for a deck form for pouring concrete, comprising:

a first elongated member forming a spine and having an L-shaped cross-section extending across adjacent channels formed in the deck form;

a plurality of channel partitions attached to the spine and extending downward into the adjacent channels, the channel partitions substantially blocking concrete poured in the deck form from flowing past the channel partitions;

each of the channel partitions having a perimeter edge shaped to substantially mirror a profile of each of the adjacent channels formed in the deck form; and a raised partition formed by a second L-shaped member assembled over the spine to form a vertical barrier above the deck form, the raised partition being configured to cooperate with the spine to block concrete poured above the channels.

15. The baffle device of claim 14, further comprising a raised partition assembled over the spine to form a wall that substantially blocks concrete poured above the adjacent channels in the deck form from flowing past the raised partition.

16. The baffle device of claim 15, wherein the raised partition is assembled over the spine after a wire mesh is laid on the spine to sandwich the wire mesh between the spine and the raised partition.

17. The baffle device of claim 14, further comprising a notch on each of the adjacent channel partitions, the notch accommodating a ridge formed in the bottom portion of the adjacent channels formed in the deck form.

18. The baffle device of claim 14, wherein the adjacent channel partitions each have an opening formed therethrough to receive a rebar.

19. The baffle device of claim 14, wherein the adjacent channel partitions are spaced substantially equally apart from one another along a length of the spine.

20. A baffle device for a deck form for pouring concrete, comprising:

a spine comprising an elongated member having an L-shaped cross section and configured to extend across adjacent channels formed in the deck form;

adjacent channel partitions on the spine for fitting within the adjacent channels formed in the deck form, the channel partitions substantially blocking concrete poured in the deck form from flowing past the channel partitions;

a perimeter edge of each of the channel partitions shaped to substantially mirror a profile of each of the adjacent channels formed in the deck form;

a raised partition comprising a second elongated member having an L-shaped cross-section, the second elongated member separate from the spine and assembled over the spine to form a wall extending above the spine to substantially block concrete poured above the adjacent channels from flowing past the raised partition; and an opening formed through each of the adjacent channel partitions to receive a rebar therethrough.

* * * * *